United States Patent [19]

Venus, Jr.

[11] 4,387,833

[45] Jun. 14, 1983

[54] APPARATUS FOR CONTAINING AND DISPENSING FLUIDS UNDER PRESSURE AND METHOD OF PRODUCING SAME

[75] Inventor: Frank Venus, Jr., Merrimack, N.H.

[73] Assignee: Container Industries, Inc., Londonderry, N.H.

[21] Appl. No.: 216,191

[22] Filed: Dec. 16, 1980

[51] Int. Cl.[3] ..... B65D 37/00

[52] U.S. Cl. ..... 222/95; 53/470; 222/105; 222/212

[58] Field of Search ..... 222/94, 95, 105, 131, 222/206, 209, 212, 214, 215, 336, 386.5, 387; 239/323, 327, 328; 53/140, 403, 412, 449, 469, 470; 493/213, 215, 217

[56] References Cited

U.S. PATENT DOCUMENTS

| | | | |
|---|---|---|---|
| 2,804,995 | 9/1957 | Fee . | |
| 2,816,690 | 12/1957 | Lari . | |
| 2,966,282 | 12/1960 | Geisler . | |
| 3,083,871 | 4/1963 | Jepson . | |
| 3,087,655 | 4/1963 | Scholle . | |
| 3,157,314 | 11/1964 | Nadler | 222/212 X |
| 3,199,742 | 8/1965 | Hill . | |
| 3,323,206 | 6/1967 | Clark . | |
| 3,552,604 | 1/1971 | Gordon . | |
| 3,580,427 | 5/1971 | Clarke . | |
| 3,672,543 | 6/1972 | Roper et al. . | |
| 3,698,595 | 10/1972 | Gortz et al. | 222/386.5 X |
| 3,727,803 | 4/1973 | Cobb | 222/215 |
| 3,733,309 | 5/1973 | Wyeth et al. . | |
| 3,738,538 | 6/1973 | Roper et al. . | |
| 3,745,149 | 7/1973 | Serafini et al. . | |
| 3,745,150 | 7/1973 | Corsover . | |
| 3,767,078 | 10/1973 | Gortz et al. . | |
| 3,791,098 | 2/1974 | Webster . | |
| 3,791,557 | 2/1974 | Venus, Jr. | 222/214 X |
| 3,796,356 | 3/1974 | Venus, Jr. . | |
| 3,803,275 | 4/1974 | Corsover . | |
| 3,876,115 | 4/1975 | Venus, Jr. et al. | 222/386.5 X |
| 3,907,169 | 9/1975 | Gortz et al. | 222/95 |
| 3,940,026 | 2/1976 | Kain . | |
| 3,946,905 | 3/1976 | Cogliano | 222/107 |
| 3,961,725 | 6/1976 | Clark . | |
| 3,981,415 | 9/1976 | Fowler et al. | 222/215 X |
| 4,052,866 | 10/1977 | Saunders . | |
| 4,067,499 | 1/1978 | Cohen . | |
| 4,077,543 | 3/1978 | Kulikowski et al. . | |
| 4,098,434 | 7/1978 | Uhlig . | |
| 4,121,737 | 10/1978 | Kain . | |
| 4,203,440 | 5/1980 | Theeuwes . | |
| 4,222,499 | 9/1980 | Lee et al. | 222/386.5 X |
| 4,251,032 | 2/1981 | Werding | 222/386.5 X |

FOREIGN PATENT DOCUMENTS

| | | |
|---|---|---|
| 78371 | 8/1976 | Australia . |
| 2304538 | 8/1974 | Fed. Rep. of Germany . |
| 2442328 | 3/1975 | Fed. Rep. of Germany . |
| 2704013 | 8/1978 | Fed. Rep. of Germany . |

OTHER PUBLICATIONS

Prof. R. B. Seymour, "The Narrowing Field of Plastics for Blow Molded Beverage Containers," *Plastics Design & Processing*, pp. 61–65, Jun. 1977.

D. D. Ray, C. B. Shriver and R. J. Gartland, "Here's Why Polyethylene Terephthalate is the Major Competitor for Beverage Container Applications, (Part 2–PET Processing Methods)," *Plastics Design & Processing*, pp. 47–50, Sep. 1977.

R. B. Fredrickson and R. O. Braselton, "Stretch-Blow Molding for Packaging Versatility," *Plastics Design & Processing*, pp. 22–26, Nov. 1979.

C. Shriver, "How to Reheat Blow Mold PET Soft--Drink Bottles," *Plastics Technology*, pp. 91–93, Oct. 1977.

G. S. Kirshenbaum and J. M. Rhodes, "Thermoplastic polyester: PET," reprinted from 1979–1980 Modern Plastics Encyclopedia by McGraw-Hill, Inc., copyright 1979, (two pages).

American Hoechst Corp., "Hoechst (registered trademark) Thermoplastic PET Resin (Preliminary Technical Bulletin".

*Primary Examiner*—Bruce H. Stoner, Jr.
*Assistant Examiner*—Edward M. Wacyra
*Attorney, Agent, or Firm*—Pennie & Edmonds

[57] ABSTRACT

An apparatus for containing and dispensing a liquid under pressure including a flexible container, preferably blow molded of a plastic composition, defining an inner region for containing the fluid under pressure and having a relatively rigid valve receptacle integral therewith for connecting a valve thereto and for connecting the flexible container to a relatively rigid outer container housing. The flexible container is inert with respect to the liquid contained therein and has a plurality of longitudinally extending creases to allow folding of the flexible container inwardly along the creases. The flexible container is capable of being folded along the creases in its empty condition radially and expanded when filled with the fluid under pressure. A tubular fabric sleeve which is elastic in radial directions and which is open at both ends, may be positioned about the flexible container in its folded condition. A tubular resilient member also open at both ends is positioned about the fabric sleeve when the flexible container is in its folded condition. The resilient member is controlled by frictional interaction with the fabric sleeve so as to be capable of expanding in substantially radial directions when the flexible container is filled with the fluid under pressure. A method of producing the inventive apparatus is also disclosed.

46 Claims, 11 Drawing Figures

APPARATUS FOR CONTAINING AND DISPENSING FLUIDS UNDER PRESSURE AND METHOD OF PRODUCING SAME

TECHNICAL FIELD

This invention relates to an apparatus for containing and dispensing fluids under pressure, and in particular to a non-aerosol container assembly for dispensing fluids or the like therefrom, and method of manufacturing same.

BACKGROUND ART

It is well known to employ fluorocarbons as propellants in dispensing fluids under pressure in container-like structures. However, recent environmental concern regarding the use of fluorocarbons and their potentially harmful effects on the ozone layers of the upper atmosphere has prompted a search for a replacement of such fluorocarbons. One such replacement includes the use of hydrocarbons which, however, have undesirable after effects and inherent dangers as well. In particular, hydrocarbons provide a flammable medium which in itself presents the danger of explosion and/or fire. Moreover, the use of propellants requires that the containers be constructed of sufficient strength so as to preserve and maintain the pressures generated within such containers. As a result, the use of such propellants provides an ever-present inherently dangerous situation in that rough handling or puncturing of the outer containers at any time can cause explosions.

Accordingly, attempts to avoid the use of propellants such as fluorocarbons or hydrocarbons have included resorting to the use of mechanical pump systems. Such pump devices disadvantageously require constant manual manipulations or pumping simply to provide release and dispersal of the fluid from the container as is typically obtained by propellant devices as noted above.

In view of the above-noted deficiencies of prior art systems, devices have been developed which incorporate an elastomeric member as described and illustrated in U.S. Pat. Nos. 3,672,543 and 3,738,538 to Roper et al.; U.S. Pat. Nos. 3,791,557 and 3,796,356 to Venus, Jr.; U.S. Pat. No. 3,876,115 to Venus, Jr. et al. and U.S. Pat. No. 3,961,725 to Clark. In the above-noted patents an elastomeric container serves to contain a fluid and is positioned within a housing whose shape the elastomeric container is intended to assume upon expansion. A valve structure positioned atop the housing communicates with the fluid within the elastomeric container. Upon activation of the valve structure, the fluid is expelled by means of the force exerted by the contraction of the elastomeric container to an unexpanded state. Furthermore, each of the patents noted above incorporates a mandrel which is positioned centrally of the elastomeric container and provides for prestressing of the container and/or evacuation of the fluid along channels or grooves along the length of the mandrel.

Such prior art devices, however, inherently suffer from the problem of odor contamination of the fluid by the rubber composition of the container. Moreover, in these devices filling the container often results in unregulated expansion. For this reason, the container can expand into various shapes and in certain instances the container expands into contact with the inner surface of the housing prior to achieving full expansion within the housing. As a result, portions of the container are subjected to frictional forces during expansion. This in turn produces wear and tear in the container structure which may thereafter operate erratically, i.e., not produce constant expression of fluid throughout the range of evacuation of the container upon activation of the valve structure. In some instances, the container may become damaged and even rendered inoperative.

In an attempt to overcome the first of the abovementioned deficiencies, U.S. Pat. No. 4,121,737 to Kain discloses an apparatus having a pressure container of suitable elastomeric material such as rubber which envelops a flexible fluid-tight bag or liner. Such liner is provided in order to prevent the fluid from contacting the elastomeric material of the pressure unit and thus to avoid acquiring undesirable odors or flavors. However, as is the case with the other patents noted above, the device of the Kain patent does not provide control or regulation for the expansion of the pressure container. Accordingly, the container expands within the housing in an uncontrolled fashion and often contacts the inner walls of the housing during its expansion. Thus, the device of the Kain patent does not avoid the distortion disadvantages and operational limitations resulting therefrom as noted above.

In addition, in known devices which employ a liner within an elastomeric container, the liner is generally of a uniform construction which does not permit easy folding about a given axis. Rather, as is the case with the device of the Kain patent, the liner is crumpled within the elastomeric container prior to being filled with a fluid. Moreover, the known liners constructed of a material of uniform thickness throughout have been known to undergo blowouts during the filling process during which greater pressures are exerted against certain portions of the liner. Blowouts have also been known to occur in liners constructed as enclosed containers and sealed in position within an outer housing. In such instances the seals themselves may weaken and rupture during filling or use. I have invented an apparatus and a method of manufacturing an apparatus for containing and dispensing fluids under pressure which overcomes the above-noted limitations of the prior art.

DISCLOSURE OF THE INVENTION

The present invention relates to an apparatus for containing and dispensing a fluid medium under pressure comprising substantially inert flexible means defining an inner region for containing the fluid medium under pressure and capable of being folded about one axis in its empty condition and expanded at least in directions substantially transverse to the axis when filled with the fluid medium under pressure. The substantially inert flexible means has relatively rigid means integral therewith for connecting valve means thereto. A resilient tubular member is positioned so as to extend at least over the length of the substantially inert flexible means and is resiliently expandable in directions substantially transverse to the axis when the flexible container means is filled with the fluid medium under pressure. Valve means is connected to the value connecting means and is adapted to substantially prevent evacuation of the flexible container means under normal conditions and capable of selectively providing communication between the inner region of the flexible container means and the outside atmosphere thereby to permit selective amounts of the pressurized fluid medium to exit the flexible container due to the generally radially inward forces provided by the resilient member in its generally expanded condition.

In a preferred embodiment, the present invention relates to an apparatus for containing and dispensing a fluid under pressure comprising preferably a synthetic polymeric, substantially non-elastomeric flexible container defining an inner region for containing the fluid under pressure and capable of being folded in its empty condition and expanded at least in substantially radial outward directions when filled with the fluid under pressure. The container is constructed of a material which is substantially inert with respect to the fluid to be contained therein. By "substantially inert" is meant that the material resists significant chemical or physical action by the fluid, thus avoiding leaching of undesirable amounts of the container material or its chemical components into the fluid. The flexible container is also preferably substantially impermable with respect to the fluid contained therein. Additionally, the relatively rigid valve connecting means also provides for connecting the flexible container to a relatively rigid outer housing.

In an alternative preferred embodiment, a sleeve is disposed radially outwardly of and surrounding the flexible container. The sleeve is generally resilient at least in radial directions and capable of being expanded at least in directions substantially transverse to the axis of the flexible container. A resilient tubular member positioned radially outwardly of the sleeve extends at least over the length of the sleeve and is resiliently expandable in radial directions when the flexible container is filled with the fluid under pressure. Valve means connected to the flexible container and adapted to substantially prevent evacuation of the flexible container under normal conditions is capable of selectively providing communication between the inner region of the flexible container and the outside atmosphere thereby to permit selective amounts of the pressurized fluid to exit the flexible container due to the generally radially inward forces provided by the resilient member in its generally expanded condition.

The flexible container is preferably constructed of a material which is substantially inert with respect to the liquid to be contained in the inner region and the tubular sleeve is constructed predominantly of knitted nylon yarns with resilient yarns positioned generally circumferentially therein at spaced locations along the length of the sleeve. The resilient tubular member is constructed of a suitable resilient material and extends over at least the length of the predominantly textile sleeve. The combination of the predominantly textile sleeve interfacing with the resilient tubular member—or energy tube—provides frictional interaction therebetween at least along longitudinal directions such that filling the flexible container with a liquid under pressure results in controlled—or programmed—uniform expansion of the resilient tubular member in radial directions along its length with extremely minor, or negligible variations. Thus, it will be seen that such uniform pressurized filling of the flexible container also provides systematic and uniform selective expulsion of the liquid as may be desired.

The flexible container is integrally formed of a plastic material, preferably polyethelene terephthalate or polyacrilonitrile. These materials, in certain instances, will program the resilient tubular member and thus avoids the need for the predominantly textile sleeve. According to a preferred method of construction, the plastic material is first injection molded as a preform which is then cooled to an amorphous structure, reheated and finally blow molded to its desired length and configuration. The flexible container has a plurality of longitudinally extending creases so as to permit inward folding along the creases. Preferably the flexible container is generally cylindrical and has an aperture at one end thereof. The aperture permits connecting the flexible container with the valve means and communication of the inner region with the outside atmosphere. Also, the flexible container has an outwardly extending integral flange adjacent the one end so as to facilitate its connection to the valve means. The flexible container wall has a thicker cross-sectional construction at both ends so as to render it capable of withstanding the pressure caused by the liquid under pressure.

If needed, the predominantly textile sleeve is preferably composed of warp-knitted textile fiber yarns at least in the longitudinal direction of the flexible container. As noted above, the textile fiber yarns are preferably constructed of nylon so as to provide the proper frictional interaction between the textile sleeve and the resilient tubular member such that expansion of the resilient tubular member is regulated to have substantially negligible variation along the longitudinal direction when the flexible container is filled with the liquid under pressure. The resilient yarn-like members are composed of a suitable elastic material such as synthetic or natural rubber or the like such that expansion of the resilient tubular member is regulated in substantially radial directions along its length when the flexible container is filled with the liquid under pressure. The predominantly textile sleeve has a length approximately equal to the length of the flexible container and is open at both ends.

The resilient tubular member preferably is constructed of rubber and also has a length approximately equal to the length of the flexible container. In addition, the resilient tubular member is open at both ends and has an inner diameter less than the outer diameter of the predominantly textile sleeve so as to provide a tight fitting assembly for the predominantly textile sleeve together with the flexible container when it is positioned thereabout.

The present invention also relates to a method for manufacturing an apparatus for containing and dispensing a fluid under pressure comprising molding a moldable material into an elongated flexible container having a relatively flexible portion which defines an inner region for containing the fluid and having at one end, a relatively rigid valve receptacle integral therewith and defining an aperture for reception of valve means, positioning valve means within the aperture and attaching the flexible container to the valve means so as to form a substantially sealed molded container defining an inner region for containing liquid, folding the flexible container inwardly along a longitudinal axis extending through the valve means, and positioning a resilient tubular member outwardly of and surrounding the sleeve, the resilient member extending at least over the length of the flexible container and capable of being expanded at least in radial directions as the flexible container means is filled with the fluid medium under pressure so as to provide sufficient potential energy within the resilient member such that selectively actuating the valve means provides communication between the inner region of the flexible container and the outside atmosphere while the expanded resilient tubular member causes expulsion of the liquid from the inner region of the flexible container through the valve means to the outside atmosphere. A plurality of creases can be provided extending along the longitudinal axis of the flexible container so as to permit the molded container to be folded inwardly along the creases.

In a preferred alternative embodiment, the method includes positioning an elongated tubular sleeve radially outwardly of, and surrounding the folded flexible container, the sleeve having generally resilient properties at least in radial directions.

Preferably the inner container is formed from a two-step molding process. A moldable material such as polyethelene terephthalate or polyacrilonitrile is first injection molded as a preform member having a general configuration defining an inner region and a valve receptacle molded integrally therewith at one end and defining an aperture for reception of valve means therein. The molded preform member is then cooled to cause the molded material to assume an amorphous structure. Next the cooled molded preform member is reheated to a temperature which causes the moldable material to soften sufficiently to be blow molded. Finally, the valve receptacle portion is maintained in fixed position while the reheated molded preform member is blow molded to cause the remaining portion defining the inner region to stretch while simultaneously causing the wall portion thereof to reduce its thickness to thereby form a blow molded container for containing a liquid.

In preferred alternative embodiment, the reheated molded preform is stretched to its predetermined desired length before being blow molded to the desired configuration.

Also, it should be noted that the method of the invention may be practiced without the step of positioning an elongated tubular knitted sleeve radially outwardly of, and surrounding the folded flexible container, thus eliminating the elongated knitted tubular sleeve.

According to a preferred method, the major portion of the flexible container has a generally cylindrical appearance, with a star-like cross-section when in its folded condition. The container also has a neck portion at one upper end and a closed lower end portion. The apparatus for containing and dispensing a liquid under pressure can be positioned, if desired, into an outer rigid or semi-rigid container housing.

The method of the invention also comprises pumping liquid under pressure into the flexible container through the valve means so as to cause generally radial expansion of at least the flexible container and the resilient tubular member at least sufficient to provide a predetermined liquid quantity and pressure within the inner region of the flexible container.

BRIEF DESCRIPTION OF THE DRAWINGS

The present invention is described in detail below herein with reference to the drawings in which.

BEST MODE FOR CARRYING OUT THE INVENTION

In the description which follows, any reference to either orientation or direction is intended primarily for the purpose of illustration and is not intended in any way as a limitation of the scope of the present invention.

Referring to the FIGS., an apparatus 10 is illustrated as including a container assembly 12 constructed according to the invention and positioned within outer container housing 14. Outer container housing 14 may be suitably bottle-shaped as shown, and may be constructed of any suitable rigid or semi-rigid material, such as plastic, metal, glass, paper, etc. The apparatus 10 also includes a valve assembly 16.

Figure 1:
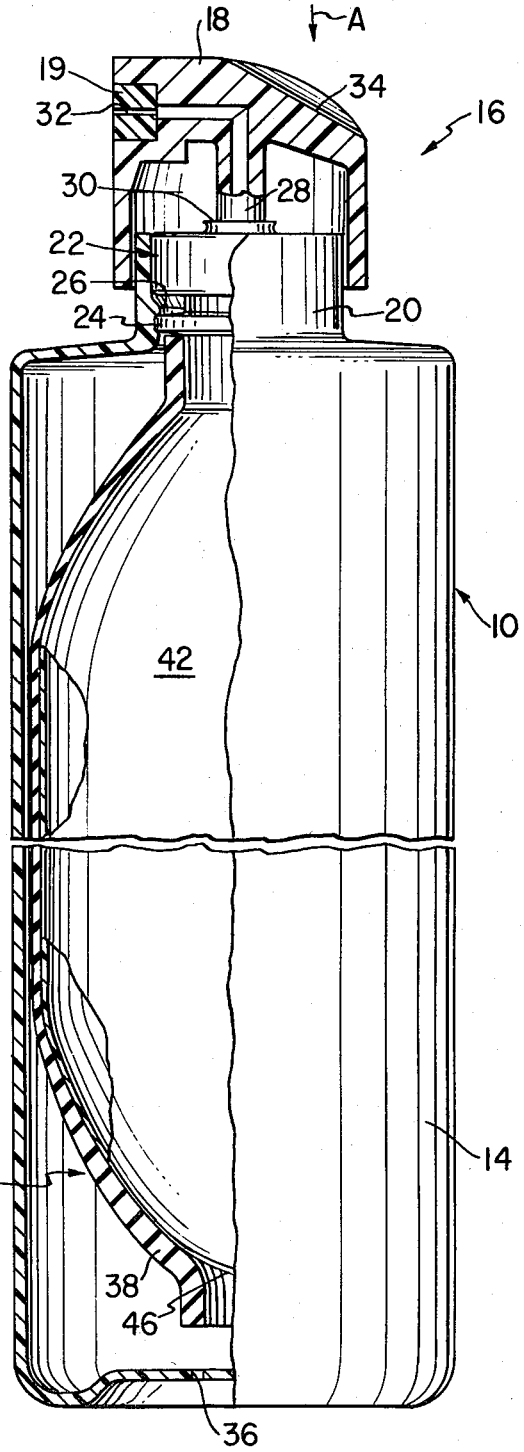
FIG. 1 is a side elevational view, partially in cross-section, of the apparatus according to the present invention illustrating the container assembly positioned in a container housing and filled with a liquid medium under pressure.

As shown in FIG. 1, the valve assembly 16 includes an actuator cap 18 which has additional liquid dispersal and dispensing structure 19. In particular, the additional valve structure 19 is properly of the type which provides first for a mechanical breakup of a liquid followed by a dispersal of the liquid upon discharge from the valve assembly 16. Other suitable valve devices may be utilized. Fluid, preferably a liquid, to be dispensed from the apparatus 10, is retained in the container assembly 12. The housing 14 at its upper end has a neck 20 which has a smaller diameter than the major portion of the housing 14. The neck 20 terminates in an opening suitably sized to permit passage of the container assembly 12 into the housing 14.

The valve assembly 16 is secured to one end of the container assembly 12 in a manner which will be described in greater detail below. The valve assembly 12 includes a valve structure 22 which cooperates together with an outwardly extending flange 24 of the container assembly 12 and an inwardly extending flange 26 on the inner surface of neck 20 to permit the container assembly 12 to be snap fitted in the container housing 14.

The neck 20 of the container housing 14, as shown in FIG. 1, is adapted for mating with the actuator cap 18 having a stem 28 positioned for selective insertion into an aperature 30 centrally positioned in the valve structure 22. As indicated above, the actuator cap 18 provides for a mechanical breakup of the fluid followed by a dispersal of the liquid upon discharge from the valve assembly 16. In use, the actuator cap is depressed in the direction of arrow "A" as shown in FIG. 1, which in turn provides for the dispensing of liquid within the container assembly 12 through the valve assembly 16, and final dispersal from the actuator cap through a suitable opening 32 in communication with aperture 30 to provide a fine liquid mist of spray, as may be desired. The actuator cap 18 has a recessed portion 34 to accomodate a finger of a human hand. The forward wall of the actuator cap 18 containing opening 30 is transverse to the opening 30 to more easily permit directing the liquid dispersed from the apparatus 10.

The apparatus 10 is shown in FIG. 1 in its final assembly after filling the container assembly 12 with a liquid to be dispensed. Upon such filling, which is accomplished by conventional means providing for an automatic operation, the container assembly 12 expands within the housing 14 as illustrated in FIG. 1. To aid in the filling operation of the container assembly 12, one or more small holes 36 may be provided preferably in the bottom of housing 14 to permit bleed air to escape. The air can also escape at the upper end from between the flanges 24 and 26.

Figure 2:
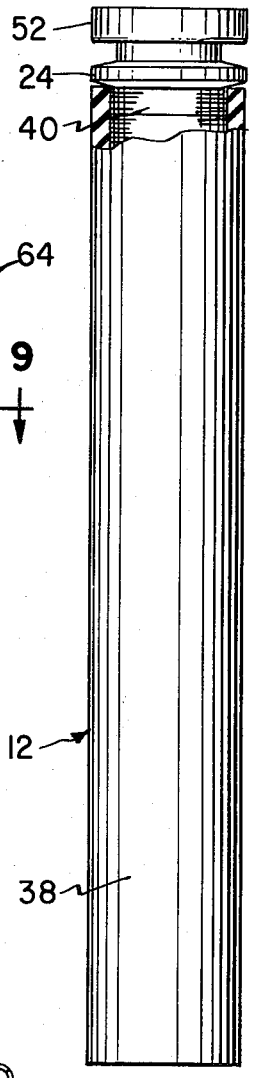
FIG. 2 is a side elevational view, partially cut-away, of the container assembly illustrating a resilient energy sleeve positioned about a fabric sleeve.
Figure 3:
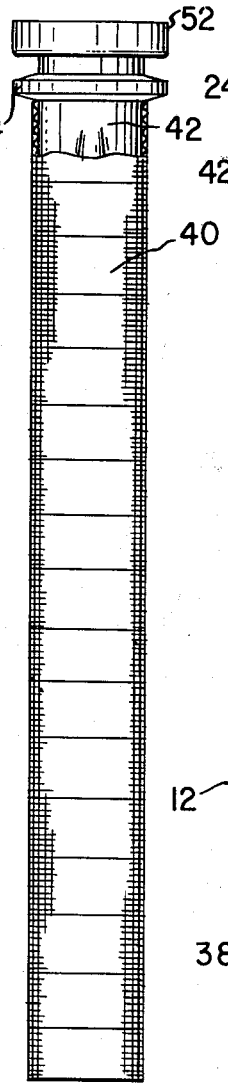
FIG. 3 is a side elevational view, partially cut-away, of the fabric sleeve of FIG. 2 positioned about an inner flexible container.

Referring to FIGS. 2 and 3, the container assembly 12 is shown in detail as including an energy tube 38 which envelopes a fabric sleeve 40. The energy tube 38 is constructed of an elastomer which has a good memory. Preferably the elastomer is rubber. The fabric sleeve 40 itself envelopes an inner flexible container or barrier pack 42. Similar fabric sleeve constructions are described in U.S. Pat. Nos. 3,981,415 and 4,052,866.

Figure 4:
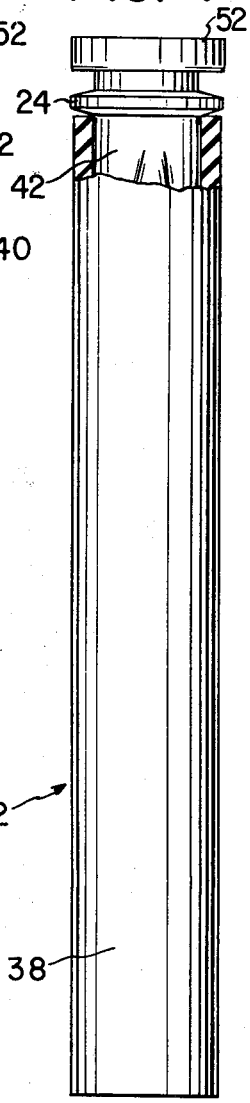
FIG. 4 is a side elevational view, partially cut-away, of an alternative embodiment of the container assembly illustrating a resilient energy sleeve positioned about the inner flexible container.

An alternative embodiment of the container assembly, as illustrated in FIG. 4, has an energy sleeve 38 which is shown in surrounding relationship about the flexible container 42 in a folded condition, but without the fabric sleeve 40 shown in the previous embodiments. By employing a flexible container 42 blow molded of a plastic composition having high tensile strength, minimum elongation, and preferably non-elastic properties, the configuration and construction of the flexible container 42 can itself provide for the regulation of the expansion of the energy sleeve 38 in a substantially radial direction with negligible if any, variations along the longitudinal axis of the flexible container 42.

Figure 5:
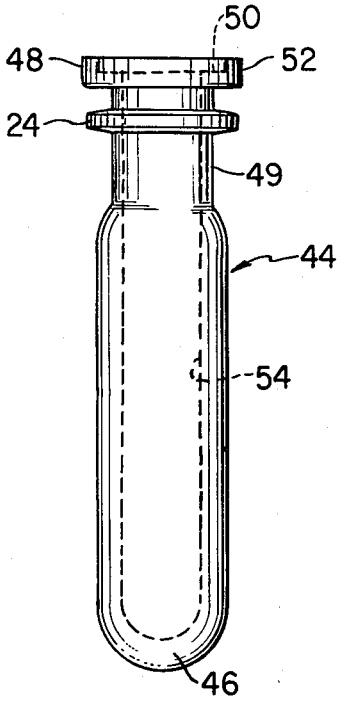
FIG. 5 is a side elevational view of the inner container initially constructed as an injection molded preform.
Figure 6:
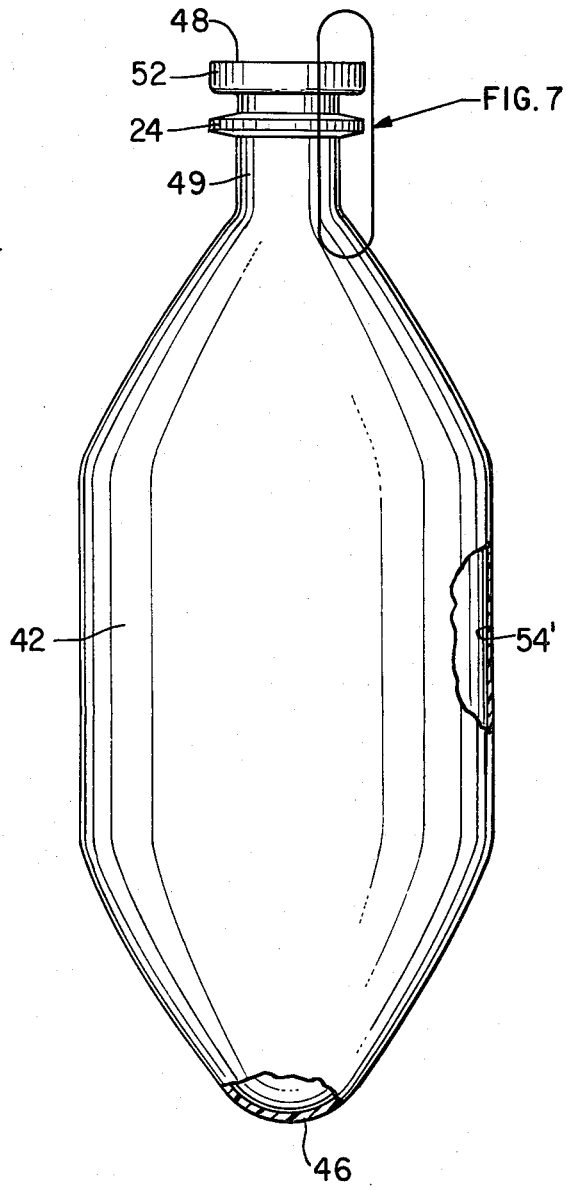
FIG. 6 is a side elevational view, partially cut-away, of the inner flexible container formed by blow molding the preform of FIG. 5.
Figure 7:
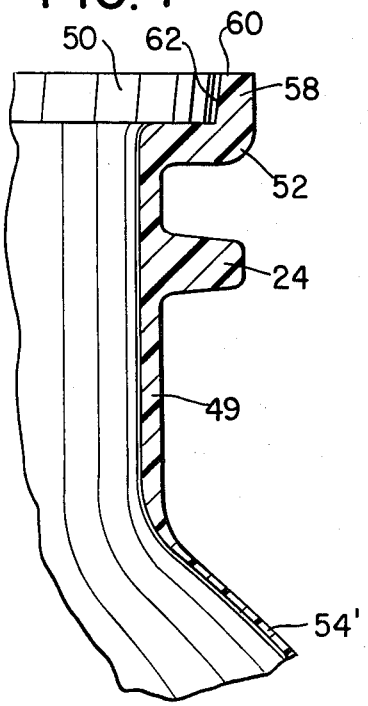
FIG. 7 is a greatly enlarged view of the relatively rigid upper valve receptacle of the inner flexible container as indicated by the circular area in FIG. 6 of the neck and part of the side of the blow-molded inner flexible container.

The structural features of the container assembly 12 will now be described with respect to a preferred method of construction of the present invention. Referring now to FIGS. 5–7, the inner flexible container or barrier pack 42 is constructed by the method to be described below. The inner flexible container 42 is first injection molded as a preform 44 having the tubular construction shown in FIG. 5. The preform 44 is closed at its lower end 46 and opened at its upper end 48 which includes a neck portion 49. The neck portion 49 defines an aperture 50 and includes flange 24 and an integrally formed flange 52 extending circumferentially about and defining aperture 50. The remaining portion of preform 44 defines an inner region 54 which communicates with the aperture 50. The flange 52 and aperture 50 define a relatively rigid valve receptacle for receiving the valve structure 22 which will be described in greater detail below. Preferably, the neck portion 49 is of a thinner construction than the remaining portion of preform 44 which defines the inner region 54 of the flexible container. The reason for this different thickness will be explained hereinbelow.

The formation of the preform 44 involves injecting a moldable material into a suitable mold cavity having the desired configuration such as that shown in FIG. 5 and described above. The preform 44 is then cooled sufficiently rapidly so as to permit the moldable material of preform 44 to assume an amorphous state. Thereafter, the cooled preform 44 is reheated to its thermoelastic state to allow the moldable material to soften sufficiently so as to permit blow molding.

Finally, the reheated preform 44 is blow molded into the flexible container 42 having the desired shape as illustrated in FIG. 6. During the blow molding process, the remaining portion of preform 44 defining the inner region 54 not only expands radially outwardly but is also stretched longitudinally to a desired predetermined length, preferably less than the length of the outer container housing 14. After cooling, the blow molded flexible container 42 now defining inner region 54' is available for further processing according to the present invention.

As noted above, the process of forming flexible containers is known to those skilled in the art as described in a Preliminary Technical Bulletin, which is incorporated herein by reference, entitled "Hoechst Thermoplastic PET Resin" by American Hoechst Corporation, Hoechst Fibers Industries, P.O. Box 5887, Spartanburg, S.C. 29304.

In an alternative process of forming the flexible container 42, the reheated preform 44 is first stretched before blow molding of same. Such pre-stretching can be achieved, e.g., by inserting and advancing a rod through the opening 50 formed in the neck portion 49 so as to stretch the reheated preform 44 to its full desired predetermined length. As a result of pre-stretching the reheated preform 44 before blow molding of same, the compositional structure of the preform 44 becomes biaxially oriented more so than without the pre-stretching step, whereby an improved, i.e., stronger flexible container 42 is obtained. Other known processes are described in U.S. Pat. Nos. 3,733,309; 3,745,149; and 3,803,275.

As shown in FIG. 6, the lower end 46 of the flexible container 42 is of a thicker construction than the remaining wall portions of the flexible container 42. This permits the lower end 46 to withstand the greater pressures to which the lower end 46 may be subjected during the filling operation of container assembly 12. In particular, the major portion of flexible container 42 is preferably of an elongated, generally cylindrical shape as shown, but still having a neck portion 49 and a closed lower end 46, and an upper end 48 having an aperture 50. The flexible container 42 has an overall length approximately equal to the length of the housing 14. The neck portion 49 has a smaller diameter than the rest of the flexible container 42. The neck 49 of the flexible container 42 is shown in greater detail in FIG. 7. The flange 52 has an upwardly extending ridge 58 having a flat upper surface 60 and an inner surface 62 which is outwardly inclined as illustrated in FIG. 7. The incline of inner surface 62 permits a good fluid-tight seal with the valve structure 22 as will be explained hereinbelow.

Preferably the plastic material is non-elastomeric and is of a homogeneous composition which may be either of a single plastic or a homogeneous mixture of a plurality of plastics or other suitable material. The plastic composition of the flexible container 42 is preferably any suitable, preferably blow moldable material. The plastic composition selected for blow molding the flexible container 42 is preferably substantially inert, i.e., resistant to chemical or physical action of the liquid to be contained within the flexible container 42 such that no substantial traces of the plastic composition—or any of its chemical components—can be detected in the fine mist spray of liquid provided by the apparatus 10. In addition, the plastic composition must further satisfy the requirement that the flexible container 42 will be substantially impermeable with respect to the liquid to be contained, i.e., as determined by the weight loss of the apparatus 10 during storage on a shelf over a long period of time. The weight loss should preferably be two percent or less per year. Preferably the plastic composition can be any of polypropelene, polyethylene terephthalate (PET), polyacrilonitrile, or a suitable thermoplastic polymer with the particular choice of composition determined by the choice of liquid to be contained in and dispensed from the apparatus 10. Other compositions may include blow-moldable materials such as polyamides (such as nylon) or the like.

Of the exemplary plastics listed above, PET or polyacrilonitrile are preferably suited. The characteristic features which render PET a desirable plastic for use in forming the flexible container 42 are described in an article, which is incorporated herein by reference, entitled "Thermoplastic polyester: PET" authored by G. S. Kirshenbaum and and J. M. Rhodes from the 1979–1980 Modern Plastics Encycopedia.

Figure 8:
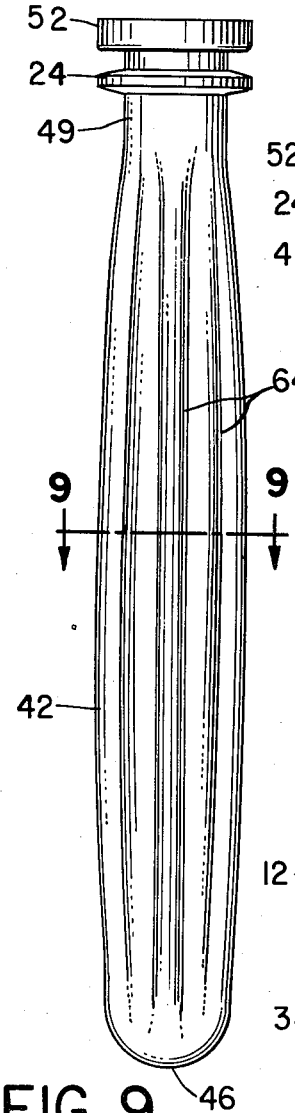
FIG. 8 is a side elevational view, illustrating the blow molded inner flexible container after forming of pleats.
Figure 9:
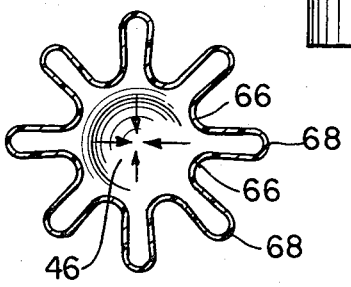
FIG. 9 is an enlarged cross-sectional view taken along the lines 9—9 of FIG. 8.

Upon blow molding the flexible container 42 into the desired shape, the flexible container 42 is provided with a plurality of creases or pleats 64 as shown in FIG. 8 which extend longitudinally from the bottom of the neck 49 to the bottom end 46. Each crease 64, as more clearly shown in FIG. 9, is a depression 66 which extends parallel to the longitudinal axis of flexible container 56 as indicated by the arrows of line 9—9 in FIG. 8. As a result, the flexible container 42 in cross section takes on a star-like pattern consisting of alternating depressions 66 and ridges 68. The creases 64 permit the flexible container 42 to be folded inwardly along the creases 64 in the direction of the arrows indicated in FIG. 9. In this fashion, the flexible container 42 can be easily folded inwardly toward its longitudinal axis in a compact and uniform manner so as to aid in regulating the expansion of the flexible container 42 in a substantially radial direction with negligible, if any, longitudinal variations. If desired, the flexible container 42 can be secured to a vacuum pump so as to evacuate the inner region 54'. In this fashion the flexible container 42 can be readily folded so as to permit the assembly of the container assembly 12 to proceed in a quick and efficient manner.

One method of forming the creases 64 is to contact the flexible container 42 with a series of suitable arranged spaced apart rods, molds, or the like which are heated and pressed against the surface of the blow molded flexible container 42. Alternatively, the flexible container 42 can be blow molded into a mold having the desired configuration which can then be removed after the flexible container 42 assumes the desired shape.

Figure 10:
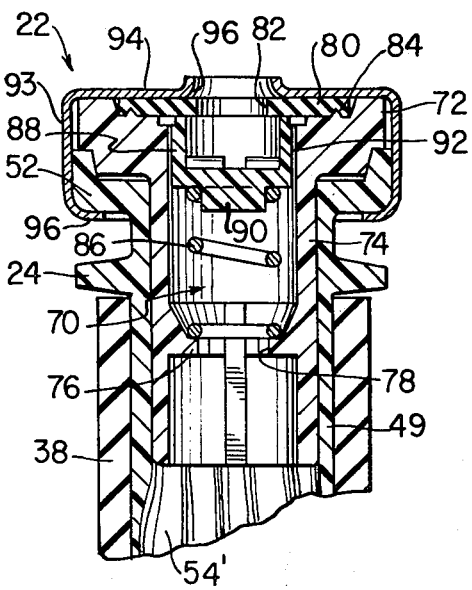
FIG. 10 is an enlarged cross-sectional view of a valve assembly connected to the relatively rigid upper valve receptacle of the container of FIG. 2.

Referring now to FIG. 10, the valve structure 22 includes a valve body 70 having a flange 72 and a downwardly extending hollow tubular portion 74 extending downwardly therefrom. The tubular portion 74 engages at its lower end an annular disk 76 integral with the inner wall of tubular portion 74 and has a centrally positioned opening 78. The upper end of tubular portion 74 is recessed to receive a rubber gasket 80 having a centrally positioned opening 82. Ridges 84 extending upwardly from the recess of the top end of tubular portion 74 provide further sealing with rubber gasket 80. A spring 86 is positioned within the hollow region of tubular portion 56 as shown in FIG. 10. The lower end of spring 86 rests against annular disk 76. The upper end of spring 86 engages a valve disk 88 having a downwardly protruding portion 90 as shown in FIG. 10 which rests inside of the spring 86. The valve disk 88 has a smaller diameter than that of the hollow region of tubular portion 74. Thus, an annular region 92 is defined about the outer surface of valve disk 88 through which fluid from inner region 54' can pass.

The flange 72 has an outside radial dimension comparable to that of flange 52 of flexible container 42. Also, the tubular portion section 74 has an outside diameter which is less than the inside diameter of the flange so as to facilitate insertion of tubular portion 74 through opening 50 of the top end 48 of flexible container 42 during assembly.

A ferrule 93, having an upper disk portion 94 and downwardly extending wall 96 which engages the outer surfaces of flanges 72 and 52.

The lower marginal edge portions of the wall 96 are then crimped inwardly so as to seal the inner region 54' from the outside atmosphere for a purpose to be explained hereinbelow. The valve disk 88 provides a fluid tight seal between its upper surface and the rubber gasket 80 when pressed thereagainst by the spring 86 under compression.

In operation, the stem 28 presses against the valve disk 88 which is thereby separated from the rubber gasket 80 so as to permit passage of liquid from the inner region 54' of flexible container 42 up through opening 78, through the hollow region within the tubular portion 74, around the valve disk 88 and out through openings 82 and 96.

Figure 11:
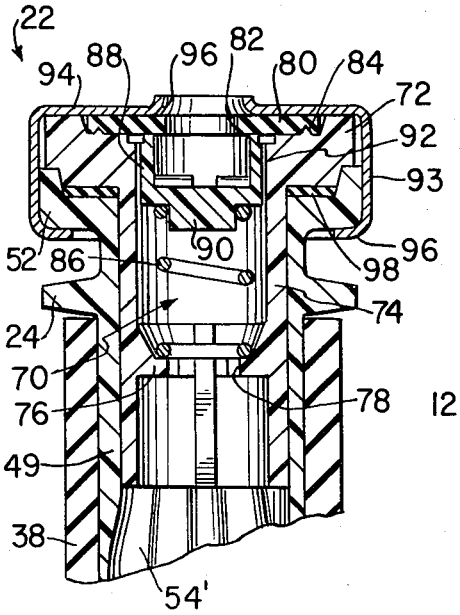
FIG. 11 is an enlarged cross-sectional view of the valve assembly of FIG. 10 illustrating the use of a gasket for sealing between the container and the valve assembly.

Referring now to FIG. 11, the valve assembly 16, if desired, can further include a gasket 98 of a suitable rubber material and sandwiched between flange 72 of valve body 70 and flange 52 of flexible container 42 to provide additional sealing.

Although the connection of the valve assembly 16 and flexible container 42 as described above in the preferred embodiment is substantially mechanical, other mechanical and nonmechanical sealing means or methods can be alternatively employed. Such other sealing means or methods which are contemplated include gluing, bonding or welding the flexible container 42 directly to the undersurface of flange 72 of valve portion 70. A preferred alternative sealing includes ultrasonically welding the flange 52 to the flange 72 and to the outer wall of tubular portion 74.

Once folded, the flexible container 42 is surrounded by fabric sleeve 40 as shown in FIG. 3 which is composed of textile fiber yarns in at least the longitudinal direction of the flexible container 42 and elastomeric fibers in the circumferential direction. The fabric sleeve 40 is open at both ends and need not be connected or secured to the valve assembly 16. A preferred construction of the fabric sleeve 40 includes a sleeve which is warp-knitted of textile yarns which include synthetic or natural rubber yarns layed into the warp knitted fabric and extend circumferentially of the sleeve at spaced locations along the length thereof. The structure of the fabric sleeve 40 is such as to permit energy sleeve 38 and thus, flexible container 42 to expand substantially in a radial direction while frictional resistance of the textile yarns prevents or minimizes any longitudinal expansion of the energy sleeve 38 during the operation of filling the container 42 with a desired liquid under pressure. The textile yarns should be suitable to provide the desirable frictional resistance and are preferably polaymide yarns, such as nylon fiber yarns.

An elastomeric energy sleeve 38 is then placed, as shown in FIG. 2, in surrounding relationship with the fabric sleeve 40. The energy sleeve 38 is similar in configuration to the fabric sleeve 40 and has an inner diameter preferably less than the outer diameter of the fabric sleeve 40 when it is positioned about flexible container 42. This provides a tight fitting assembly for fabric sleeve 40 and flexible container 42. The energy sleeve 38 is also open at both ends as is the fabric sleeve 40 and similarly need not be secured to the valve assembly 16 as was necessary in the prior art arrangements. For this reason, the avoidance of additional connecting fasteners eliminates the problems caused by failures of such fasteners in the prior art arrangements. Once expanded, the energy sleeve 38 provides a contracting force to return the container 42 toward its original folded condition as the liquid under pressure is selectively permitted to exit the container 42.

Once assembled as shown in FIG. 2, the container assembly 12 is positioned within container housing 14 and snap-fitted thereto by securement of the valve assembly 16 to the flange 26 of housing 12 as described above with reference to FIG. 1.

Upon connecting the apparatus 10 to a suitable filling device (not shown), the container assembly 12 is filled with the desired liquid medium whereupon the container assembly 12 expands to its filled condition as shown in FIG. 1. Upon slidably fitting the actuator cap 18 onto the valve structure 22 with stem 28 extending through aperture 30, the apparatus 10 is ready for use. Pressing the actuator cap 18 downwardly in the direction of arrow "A" as illustrated in FIG. 1 opens the valve structure 22 so as to permit liquid within inner region 52 of flexible container 42 to pass freely through opening 32 of actuator cap 18 as a fine mist spray.

Preferably the outer surface of the energy sleeve 38 is slightly inward of the inner surface of container housing 14 so as to avoid distortion of the container housing 14. As a result of the structure of the fabric sleeve 40, the longitudinal nylon yarns provide frictional resistance in the longitudinal direction against the inner surface of energy sleeve 38 and the expansion of the energy sleeve 38 is regulated or programmed so as to expand substantially in a radial direction with negligible, if any, longitudinal variation. However, the overall length of the container assembly 12 in its filled condition may be slightly less than in its unfilled condition.

Accordingly, the energy sleeve 38 may fully expand to its desired size within the housing 14 without engaging any portions of the inner wall of housing 14 prior to achieving full expansion. In doing so, the energy sleeve 38 is not subjected to the difficulties encountered in known dispenser systems as described above. Furthermore, the dispensing of liquid from the flexible container 42 is obtained in a constant fashion from the completed apparatus 10 without any erratic departures therefrom.

I claim:

1. An apparatus for containing and dispensing a fluid medium under pressure comprising:

(a) substantially inert flexible means defining an inner region for containing the fluid medium under pressure and capable of being folded about one axis in its empty condition and expanded at least in directions substantially transverse to said axis when filled with the fluid medium under pressure, said substantially inert flexible means having relatively rigid means integral therewith for connecting valve means thereto;

(b) a resilient tubular member positioned so as to extend at least over the length of said substantially inert flexible means and being expandable in directions substantially transverse to said axis when said flexible container means is filled with the fluid medium under pressure such that frictional interaction between said substantially inert flexible means and said resilient tubular member at least in longitudinal directions prevents substantial elongation of said resilient tubular member when said substantially inert flexible means is filled with the fluid medium under pressure but permits expansion of said resilient tubular member in radially outward directions substantially uniformly along its length; and (c) valve means connected to said valve connecting means and adapted to substantially prevent evacuation of said flexible container means under normal conditions and capable of selectively providing communication between said inner region of said flexible container means and the outside atmosphere thereby to permit selective amounts of the pressurized fluid medium to exit said flexible container due to the generally inward forces provided by said resilient member in its generally expanded condition.

2. An apparatus for containing and dispensing a fluid under pressure comprising:

(a) a flexible container defining an inner region for containing the fluid under pressure and capable of being folded in its empty condition and expanded at least in substantially radial outward directions when filled with the fluid under pressure, said container being constructed of a material which is chemically substantially inert with respect to the fluid to be contained therein and having relatively rigid means integral therewith for connecting valve means thereto;

(b) a resilient tubular member positioned radially outwardly of and extending at least over the length of said flexible container and being expandable at least in radial directions when said flexible container is filled with the fluid under pressure such that frictional interaction between said flexible container and said resilient tubular member at least in longitudinal directions prevents substantial elongation of said resilient tubular member when said flexible container is filled with the fluid under pressure but permits expansion of said resilient tubular member in radially outward directions substantially uniformly along its length; and (c) valve means connected to said valve connecting means of said flexible container and adapted to substantially prevent evacuation of said flexible container under normal conditions, said valve means being capable of selectively providing communication between said inner region of said flexible container and the outside atmosphere thereby to permit selective amounts of the pressurized fluid to exit said flexible container due to the generally radially inward forces provided by said resilient member in its generally expanded condition.

3. An apparatus for containing and dispensing a fluid under pressure comprising:

(a) a flexible container defining an inner region for containing the fluid under pressure and capable of being folded about one axis in its empty condition and expanded at least in substantially radial outward directions when filled with the fluid under pressure, said container being constructed of a material which is chemically substantially inert with respect to the fluid to be contained therein and having relatively rigid means formed integral therewith for connecting valve means thereto and for connecting the flexible container to a relatively rigid outer housing;

(b) a sleeve disposed radially outwardly of and surrounding said flexible container, said sleeve being generally resilient at least in directions substantially transverse to said axis;

(c) a resilient tubular member positioned radially outwardly of said sleeve, said resilient member extending at least over the length of said sleeve and being expandable at least in radial directions when said flexible container is filled with the fluid under pressure such that frictional interaction between said sleeve and said resilient tubular member at least in longitudinal directions prevents substantial elongation of said resilient tubular member when said flexible container is filled with the fluid under pressure but permits expansion of said resilient tubular member in radially outward directions substantially uniformly along its length; and (d) valve means connected to said valve connecting means of said flexible container adapted to substantially prevent evacuation of said flexible container under normal conditions, said valve means being capable of selectively providing communication between said inner region of said flexible container and the outside atmosphere thereby to permit selective amounts of the pressurized fluid to exit said flexible container due to the generally radially inward forces provided by said resilient member in its generally expanded condition.

4. An apparatus for containing and dispensing a liquid under pressure comprising:

(a) a flexible container defining an inner region for containing the liquid under pressure and capable of being folded in its empty condition and expanded at least in substantially radial outward directions when filled with the liquid under pressure, said flexible container being constructed of a material which is substantially non-permeable and substantially chemically inert at least with respect to the liquid to be contained therein, said flexible container having substantially relatively rigid means formed integral therewith for connecting valve means thereto and for connecting said flexible container to a relatively rigid outer housing;

(b) a generally elongated, tubular sleeve disposed radially outwardly of and surrounding said flexible container, said sleeve being constructed predominantly of textile yarns at least in longitudinal directions and having resilient yarn-like members in circumferential directions at spaced positions along its length such that said sleeve is generally resilient when expanded at least in substantially radial outward directions when said flexible container is filled with the liquid under pressure;

(c) a generally elongated, resilient tubular member positioned radially outwardly of said predominantly textile sleeve, said tubular member extending at least over the length of said predominantly textile sleeve and being expandable at least in radial directions when said flexible container is filled with the liquid under pressure such that frictional interaction between said predominantly textile sleeve and said resilient tubular member at least in longitudinal directions prevents substantial elongation of said resilient tubular member when said flexible container is filled with the liquid under pressure but permits expansion of said resilient tubular member in radially outward directions substantially uniformly along its length; and (d) valve means connected to said valve connecting means of said flexible container and adapted to substantially prevent evacuation of said flexible container under normal conditions and capable of selectively providing communication between said inner region of said flexible container and the outside atmosphere thereby to permit selective amounts of said pressurized liquid to exit said flexible container due to the generally radially inward forces provided by said resilient tubular member in its generally expanded condition.

5. An apparatus for containing and dispensing a liquid under pressure comprising:

(a) a non-elastomeric, substantially non-permeable flexible container defining an inner region for containing the liquid under pressure and capable of being folded in its empty condition and expanded at least in substantially radial outward directions when filled with the liquid under pressure, said flexible container being constructed of a material which is substantially chemically inert with respect to the liquid to be contained therein, said flexible container having a relatively rigid valve receptacle formed integral therewith for connecting valve means thereto and for connecting said flexible container to a relatively rigid outer container housing;

(b) a generally elongated, tubular sleeve disposed radially outwardly of and surrounding said flexible container, said sleeve being constructed predominantly of textile yarns at least in longitudinal directions and having resilient yarn-like members in circumferential directions at spaced positions along its length such that said sleeve is generally resilient when expanded at least in substantially radial outward directions when said flexible container is filled with the liquid under pressure;

(c) a generally elongated, resilient tubular member positioned radially outwardly of said predominantly textile sleeve, said tubular member extending at least over the length of said predominantly textile sleeve and being expandable at least in radial directions when said flexible container is filled with the liquid under pressure such that frictional interaction between said predominantly textile sleeve and said resilient tubular member at least in longitudinal directions prevents substantial elongation of said resilient tubular member when said flexible container is filled with the liquid under pressure but permits expansion of said resilient tubular member in radially outward directions substantially uniformly along its length; and (d) valve means connected to said valve receptacle of said flexible container and adapted to substantially prevent evacuation of said flexible container under normal conditions and capable of selectively providing communication between said inner region of said flexible container and the outside atmosphere thereby to permit selective amounts of said pressurized liquid to exit said flexible container due to the generally radially inward forces provided by said resilient tubular member in its generally expanded condition.

6. The apparatus according to claim 5 wherein said flexible container is formed of a plastic material.

7. The apparatus according to claim 6 wherein said flexible container is integrally molded of a plastic material.

8. The apparatus according to claim 7 wherein said plastic material is first integrally injection molded of a plastic composition as a preform, and the portion defining said inner region is subsequently blow molded.

9. The apparatus according to claim 8 wherein said plastic composition is polyethylene terephthalate.

10. The apparatus according to claim 8 wherein said plastic composition is polyacrilonitrile.

11. The apparatus according to claim 8 wherein said flexible molded container has a plurality of generally longitudinally extending creases so as to permit said flexible molded container to be folded inwardly along said creases.

12. The apparatus according to claim 11 wherein said flexible molded container is of a generally cylindrical configuration and said valve receptacle is positioned at one end thereof and defines an aperture at one end thereof to which the plurality of said creases extend, said aperture permitting connection of said molded container with said valve means to provide selective communication of the inner region with the outside atmosphere through said valve means.

13. The apparatus according to claim 12 wherein said valve receptacle has a generally radially outwardly extending integral flange so as to facilitate connection of said molded container to an outer housing.

14. The apparatus according to claim 13 wherein said flexible molded container is of a thicker construction at the end portion opposite said valve receptacle so as to render said molded container capable of withstanding pressures caused by the liquid under pressure.

15. The apparatus according to claim 14 wherein said valve means includes a valve body having a generally hollow tubular portion adapted to be capable of insertion within said aperture of said valve receptacle, said valve means including at least one suitable aperture to permit communication between said inner region of said container and the outside atmosphere upon activation of said valve means.

16. The apparatus according to claim 15 wherein said valve receptacle includes a radially outwardly extending flange and said valve means includes a flange corresponding in configuration and dimension to that of said flange of said valve receptacle and adapted so as to facilitate snapped engaged reception of said valve means within said valve receptacle.

17. The apparatus according to claim 16 further comprising a ferrule configured and dimensioned to be capable of securing together said flange of said valve body and said flange of said valve receptacle, said ferrule being crimped in position about outer edge portions of the flanges of the valve body and valve receptacle so as to tightly secure said flanges.

18. The apparatus according to claim 17 wherein a rubber gasket is positioned centrally between the ferrule and the valve body.

19. The apparatus according to claim 18 further including a valve disk positioned within the hollow region of the tubular portion, a spring positioned within the hollow region so as to bias the valve disk against the rubber gasket so as to provide a fluid tight seal therebetween.

20. The apparatus according to claim 19 wherein the valve disk is of a smaller radial dimension than the hollow region so as to permit liquid from said inner region of said container to pass through the hollow region and around the sides of the valve disk into the atmosphere when said valve means is activated.

21. The apparatus according to claim 20 further including a rubber gasket positioned between the flange of the valve body and said flange of said container so as to further aid in providing a fluid tight seal therebetween.

22. The apparatus according to claim 5 wherein said predominantly textile sleeve is a tubular member comprised of textile fiber yarns at least in the longitudinal direction of said flexible container.

23. The apparatus according to claim 22 wherein said textile fiber yarns are constructed of nylon so as to provide increased frictional interaction between said textile sleeve and said resilient tubular member such that expansion of said resilient tubular member is regulated to have substantially negligible variations along the longitudinal direction when said flexible container is filled with the liquid under pressure.

24. The apparatus according to claim 22 wherein said textile fiber yarns are constructed of polyester so as to provide increased frictional interaction between said textile sleeve and said resilient tubular member such that expansion of said resilient tubular member is regulated to have substantially negligible variations along the longitudinal direction when said flexible container is filled with the liquid under pressure.

25. The apparatus according to claim 22 wherein said resilient yarn-like members are comprised of a rubber composition such that expansion of said resilient tubular member is regulated in substantially radial directions along its length when said flexible container is filled with the liquid under pressure.

26. The apparatus according to claim 25 wherein the rubber composition is synthetic rubber.

27. The apparatus according to claim 25 wherein the rubber composition is natural rubber.

28. The apparatus according to claim 25 wherein said predominantly textile sleeve has a length approximately equal to or less than the length of said flexible container.

29. The apparatus according to claim 28 wherein said predominantly textile sleeve is open at both ends.

30. The apparatus according to claim 29 wherein said resilient tubular member is constructed of an elastomer.

31. The apparatus according to claim 30 wherein said elastomer is rubber and said resilient tubular member has a length approximately equal to the length of said flexible container.

32. The apparatus according to claim 31 wherein said resilient tubular member is open at both ends.

33. The apparatus according to claim 32 wherein said resilient tubular member has an inner diameter less than the outer diameter of said fabric sleeve so as to provide a relatively tight fitting assembly for said textile sleeve about said flexible container when positioned about said flexible container.

34. An apparatus for containing and dispensing a liquid under pressure comprising:

(a) a container housing having an opening at one end thereof;

(b) a non-elastomeric flexible container integrally formed of a molded generally homogeneous plastic composition and having a plurality of generally longitudinally extending creases, said molded container defining an inner region for containing the liquid under pressure and capable of being folded inwardly along said creases about a longitudinal axis thereof in its empty condition and expanded at least in substantially radially outward directions when filled with the liquid under pressure, said molded container being chemically substantially inert with respect to the liquid to be contained therein, said flexible container having a relatively rigid valve receptacle constructed integral therewith for connecting valve means including a valve body thereto and for connecting said molded container to said container housing;

(c) a generally elongated, tubular textile sleeve disposed radially outwardly of and surrounding said molded container, said textile sleeve being generally resilient at least in radial directions and having resilient yarn-like members in circumferential directions along its length such that said textile sleeve is capable of being expanded in substantially radial directions when said molded container is filled with the liquid under pressure, said textile sleeve being knitted of nylon fiber yarns;

(d) a resilient generally tubular member positioned radially outwardly of said textile sleeve, said resilient tubular member extending at least over the length of said textile sleeve and being expandable in radial directions when said molded container is filled with the liquid under pressure, said resilient tubular member frictionally interacting with said nylon yarns of said textile sleeve when said molded container is filled with the liquid under pressure such that said resilient tubular member expands generally uniformly in substantially radial directions along its length; and (e) valve means connected to said valve receptacle of said molded container, said valve receptacle further being secured to one end of said container housing at the opening thereof when said molded container, textile sleeve and resilient tubular member are assembled and positioned therein, said valve means being adapted to substantially prevent evacuation of said molded container under normal conditions and capable of selectively providing communication between said inner region of said molded container and the outside atmosphere thereby to permit selective amounts of said pressurized liquid to become dispersed and to exit said molded container due to the generally radially inward forces provided by said resilient tubular member in its generally expanded condition.

35. An apparatus for containing and dispensing a liquid under pressure comprising:

(a) a relatively rigid container housing having an opening at one end thereof;

(b) a flexible container integrally formed of a molded generally homogeneous plastic composition such as polyethylene terephthalate or polyacrilonitrile, and having a plurality of longitudinally extending creases, said molded container defining an inner region for containing the liquid under pressure and capable of being folded inwardly along said creases about a longitudinal axis thereof in its empty condition and expanded at least in substantially radially outward directions when filled with the liquid under pressure, said molded container being chemically substantially inert with respect to the liquid contained therein, said configuration and structure of said molded container being such that said molded container is capable of being expanded in substantially radial directions when said molded container is filled with the liquid under pressure, said flexible container having a relatively rigid valve receptacle constructed integral therewith and defining an aperture for reception of valve means therein and for connecting said molded container to said container housing;

(c) a resilient generally tubular member positioned radially outwardly of said molded container, said resilient tubular member extending at least over the length of said molded container and being expandable in radial directions when said molded container is filled with the liquid under pressure, said resilient tubular member frictionally interacting with said molded container when said molded container is filled with the liquid under pressure such that said resillient tubular member expands generally uniformly in substantially radial directions along its length; and (d) valve means connected to said valve receptacle of said molded container, said valve receptacle further being secured to one end of said container housing at the opening thereof when said molded container and resilient tubular member are assembled and positioned therein, said valve means being adapted to substantially prevent evacuation of said molded container under normal conditions and capable of selectively providing communication between said inner region of said molded container and the outside atmosphere thereby to permit selective amounts of said pressurized liquid to become dispersed and to exit said molded container due to the generally radially inward forces provided by said resilient tubular member in its generally expanded condition.

36. A method for manufacturing an apparatus for containing and dispensing a fluid under pressure comprising:

(a) molding a moldable material into an elongated flexible container having a relatively flexible portion which defines an inner region for containing the fluid and having at one end, a relatively rigid valve receptacle integral therewith and defining an aperture for reception of valve means;

(b) positioning valve means within said aperture and attaching said flexible container to said valve means so as to form a substantially sealed molded container defining an inner region for containing fluid;

(c) folding said flexible container inwardly along a longitudinal axis extending through said valve means;

(d) positioning a resilient tubular member outwardly of and surrounding said flexible container, said resilient member extending at least over the length of said relatively flexible container portion and capable of being expanded at least in radial directions as said flexible container means is filled with the fluid medium under pressure so as to provide sufficient potential energy within said resilient member such that selectively actuating said valve means provides communication between the inner region of said flexible container and the outside atmosphere while said expanded resilient tubular member causes expulsion of said fluid from the inner region of said flexible container through the valve means to the outside atmosphere.

37. A method for manufacturing an apparatus for containing and dispensing a liquid under pressure comprising:

(a) molding a moldable material into an elongated flexible container having a configuration which defines an inner region for containing the liquid and having at one end, a relatively rigid valve receptacle integral therewith and defining an aperture for reception of valve means;

(b) creating a plurality of creases extending along the longitudinal axis of said flexible container so as to permit said molded container to be folded inwardly along said creases;

(c) positioning valve means within said aperture and attaching said flexible container to said valve means so as to form a substantially sealed molded container defining an inner region for containing liquid;

(d) folding said flexible container inwardly along said creases along a longitudinal axis extending through said valve means;

(e) positioning an elongated tubular sleeve radially outwardly of, and surrounding said folded flexible container, said sleeve having generally resilient properties at least in radial directions; and (f) positioning a resilient tubular member outwardly of and surrounding said sleeve, said resilient member extending at least over the length of said sleeve and capable of being expanded at least in radial directions as said flexible container means is filled with the liquid medium under pressure so as to provide sufficient potential energy within said resilient member such that selectively actuating said valve means provides communication between the inner region of said flexible container and the outside atmosphere while said expanded resilient tubular member causes expulsion of said liquid from the inner region of said flexible container through the valve means to the outside atmosphere.

38. A method for manufacturing an apparatus for containing and dispensing a liquid under pressure comprising:

(a) taking a moldable material and injection molding a preform member having a general configuration defining an inner region and a valve receptacle molded integrally therewith at one end and defining an aperture for reception of valve means therein;

(b) cooling said molded preform member to cause the molded material to assume an amorphous state;

(c) reheating said cooled molded preform member to a temperature which causes the moldable material to soften sufficiently to be blow molded;

(d) maintaining said valve receptacle portion in fixed position while blow molding the remaining portion of said reheated molded preform member to cause said remaining portion defining said inner region to stretch while simultaneously causing the wall portion thereof to reduce its thickness to thereby form a blow molded container for containing a liquid;

(e) forming a plurality of creases extending along the longitudinal axis of said blow molded container so as to permit said blow molded container to be folded inwardly along said creases;

(f) positioning valve means within said aperture and positioning said valve means within said valve receptacle so as to seal said blow molded container and the portion defining an inner region for containing liquid;

(g) folding said flexible container inwardly along said creases along a longitudinal axis extending through said valve means;

(h) positioning an elongated tubular sleeve radially outwardly of, and surrounding said folded flexible container, said sleeve having generally resilient properties at least in radial directions; and (i) positioning a resilient tubular member outwardly of and surrounding said sleeve, said resilient member extending at least over the length of said sleeve and capable of being expanded at least in radial directions as said flexible molded container means is filled with the liquid medium under pressure so as to provide sufficient potential energy within said resilient member such that selectively actuating said valve means provides communication between the inner region of said blow molded container and the outside atmosphere while said expanded resilient tubular member causes expulsion of said liquid from the inner region of said blow molded container through the valve means to the outside atmosphere.

39. A method for manufacturing an apparatus for containing and dispensing a liquid under pressure comprising:

(a) taking a moldable material and injection molding a preform member having a general configuration defining an inner region and a relatively rigid valve receptacle molded integrally therewith at one end and defining an aperture for reception of valve means therein;

(b) cooling said molded preform member sufficiently rapidly to cause the molded material to assume an amorphous state;

(c) reheating said cooled molded preform member;

(d) stretching said reheated molded preform to its predetermined desired length;

(e) gripping said valve receptable while simultaneously blow molding the portion of said stretched molded preform member to cause said wall portion thereof to reduce its thickness to thereby form a blow molded container for containing a liquid;

(f) forming a plurality of creases extending along the longitudinal axis of said blow molded container so as to permit said blow molded container to be folded inwardly along said creases;

(g) positioning valve means within said aperture and positioning said valve means within said valve receptacle so as to seal said blow molded container and the portion defining an inner region for containing liquid;

(h) folding said flexible container inwardly along said creases along a longitudinal axis extending through said valve means;

(i) positioning an elongated tubular sleeve radially outwardly of, and surrounding said folded flexible container, said sleeve having generally resilient properties at least in radial directions; and (j) positioning a resilient tubular member outwardly of and surrounding said sleeve, said resilient member extending at least over the length of said sleeve and capable of being expanded at least in radial directions as said flexible molded container means is filled with the liquid medium under pressure so as to provide sufficient potential energy within said resilient member such that selectively actuating said valve means provides communication between the inner region of said blow molded container and the outside atmosphere while said expanded resilient tubular member causes expulsion of said liquid from the inner region of said blow molded container through the valve means in the outside atmosphere.

40. A method for manufacturing an apparatus for containing and dispensing a liquid under pressure comprising:

(a) taking a moldable plastic material capable of being first preform injection molded and then blow molded into a flexible container and first injection molding a preform member defining an inner region and having a relatively rigid valve receptacle formed integrally therewith at one end and defining an aperture for reception of valve means therein, said relatively rigid valve receptacle adapted for connecting said flexible container to a relatively rigid outer housing;

(b) cooling said preform member sufficiently rapidly to cause said plastic material to become amorphous;

(c) heating said preform member at least in the portion defining said inner region, to a temperature at which the material becomes plastic;

(d) gripping said valve means receptacle and blow molding said portion defining said inner region sufficiently to cause said portion to enlarge while causing the wall portions thereof to reduce in thickness;

(e) creating a plurality of creases extending along the longitudinal axis of said flexible container so as to permit said blow molded portion to be folded inwardly along said creases;

(f) positioning valve means within said aperture and attaching said valve means to said valve receptacle so as to form a substantially sealed blow molded portion defining an inner region for containing liquid;

(g) folding said flexible container inwardly along said creases along a longitudinal axis extending through said valve means; and (h) positioning a resilient tubular member outwardly of and surrounding said blow molded container, said resilient member extending at least over the length of said blow molded container and capable of being expanded at least in radial directions as said blow molded container is filled with the liquid medium under pressure so as to provide sufficient potential energy within said resilient member such that selectively actuating said valve means provides communication between the inner region of said blow molded container and the outside atmosphere while said expanded resilient tubular member causes expulsion of said liquid from the inner region of said blow molded container through the valve means to the outside atmosphere.

41. The method according any of claims 36–40 wherein the major portion of said flexible container is generally cylindrical.

42. The method according to claim 41 further comprising positioning said apparatus for containing and dispensing a liquid under pressure into a relatively rigid outer container housing.

43. The method according to claim 42 further comprising pumping liquid under pressure into said flexible container through said valve means so as to at least cause generally radial expansion of said flexible container, and said resilient tubular member at least sufficient to provide a predetermined liquid quantity and pressure within said inner region of said flexible container.

44. The method according to any of claims 37 and 38 wherein said sleeve is a predominantly textile sleeve of warp knit nylon construction having resilient yarn-like members positioned therein and extending generally circumferentially at spaced locations along the length of said sleeve.

45. The method according to any of claims 38–40 wherein said moldable material is polyethylene terephthalate.

46. The method according to any of claims 38–40 wherein said moldable material is polyacrilonitrile.

* * * * *